United States Patent [19]

Hertrich

[11] Patent Number: 4,762,311

[45] Date of Patent: Aug. 9, 1988

[54] ADJUSTING ROLLER ARRANGEMENT PARTICULARLY FOR ROTARY FOLDERS

[75] Inventor: Klaus Hertrich, Göhrenz, German Democratic Rep.

[73] Assignee: Veb Kombinat Polygraph "Werner Lamberz" Leipzig, Leipzig, German Democratic Rep.

[21] Appl. No.: 78,514

[22] Filed: Jul. 27, 1987

[30] Foreign Application Priority Data

Jul. 25, 1986 [DD] German Democratic Rep. .. 2928585

[51] Int. Cl.[4] ..... B41L 43/04

[52] U.S. Cl. ..... 270/41; 226/174; 226/179; 226/181; 226/190

[58] Field of Search ..... 270/5, 40–41; 226/174, 176, 177, 179–181, 184, 188, 189, 190, 192

[56] References Cited

U.S. PATENT DOCUMENTS

| | | | |
|---|---|---|---|
| 1,186,970 | 6/1916 | Luttrell | 270/41 |
| 2,024,618 | 12/1935 | Whiting | 226/180 |
| 2,622,875 | 12/1952 | Lorig | 226/192 |
| 2,727,739 | 12/1955 | Harless et al. | 226/180 |
| 2,840,376 | 6/1958 | Harless | 226/174 |
| 2,868,539 | 1/1959 | Kuons et al. | 270/41 |
| 3,819,172 | 6/1974 | Santaella | 270/41 |
| 3,913,813 | 10/1975 | Morse | 226/192 X |
| 4,078,416 | 3/1978 | Voorhees et al. | 226/181 |
| 4,089,254 | 5/1978 | Kindig | 226/181 |
| 4,552,295 | 11/1985 | Smith et al. | 226/180 |

FOREIGN PATENT DOCUMENTS

| | | |
|---|---|---|
| 2622717 | 7/1977 | Fed. Rep. of Germany . |
| 2707657 | 8/1978 | Fed. Rep. of Germany . |

*Primary Examiner*—Eugene H. Eickholt

*Attorney, Agent, or Firm*—Michael J. Striker

[57] ABSTRACT

An adjusting roller pair, particularly for a rotation folding apparatus in which each roller has an axle, at the ends of which adjusting devices are supported by sleeves to adjust the roller horizontally, vertically and axially. Each roller has a roller body formed of two portions and a non-rotating internal tube. The two portions of the roller body are supported at their ends and horizontally adjustable. The pair of adjusting rollers are employed when non-uniform web tensions transverse to the material web, such as paper, are compensated.

4 Claims, 5 Drawing Sheets

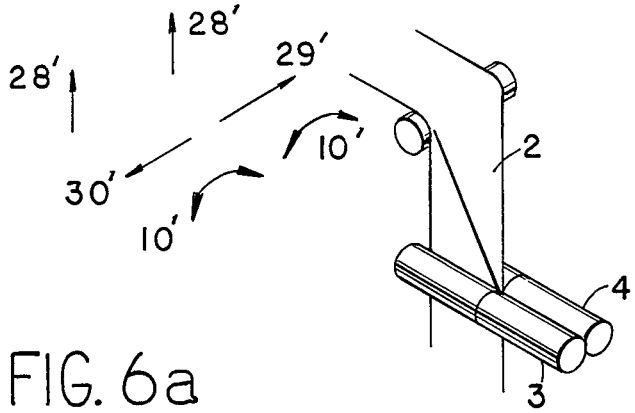
FIG. 6
FIG. 6a
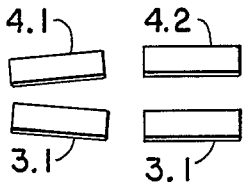
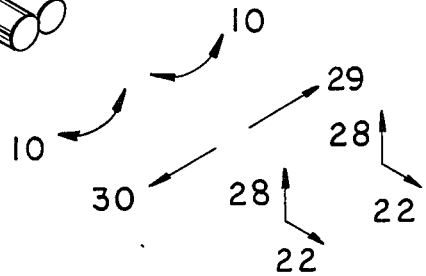
FIG. 7a
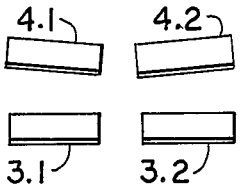
FIG. 7
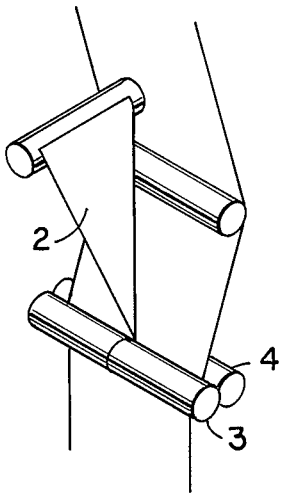
FIG. 8
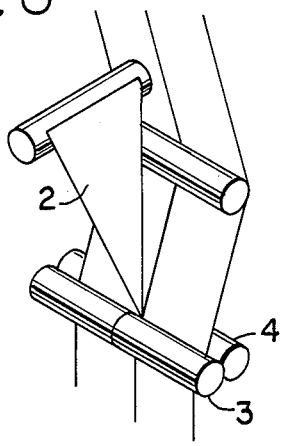
FIG 8a
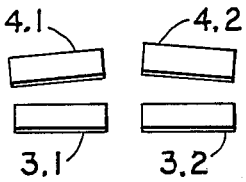

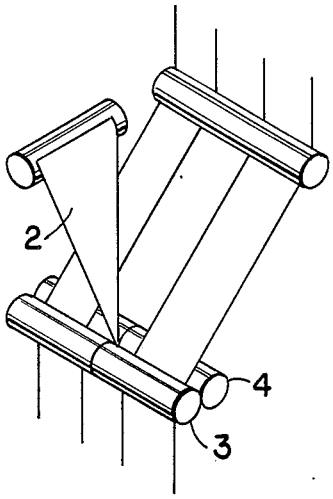
FIG. 9
FIG. 9a
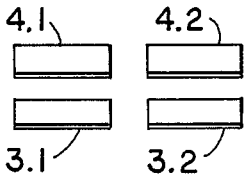
FIG. 10a
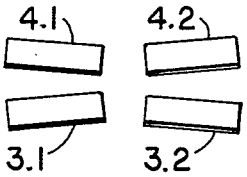
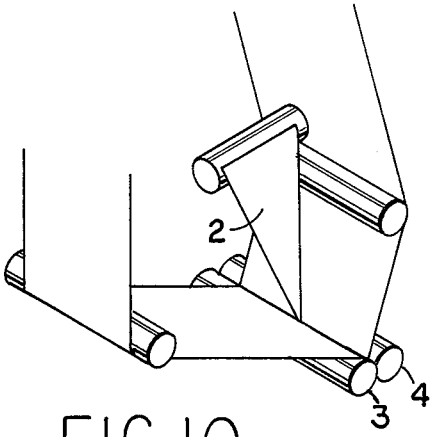
FIG. 10
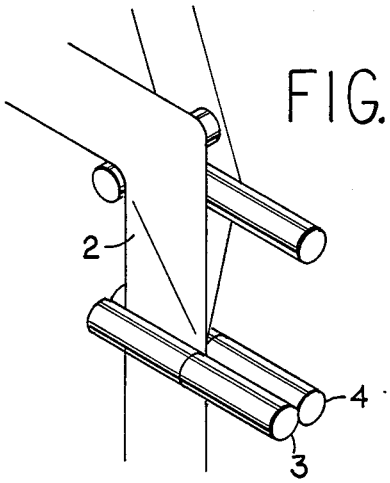
FIG. 11
FIG. 11a
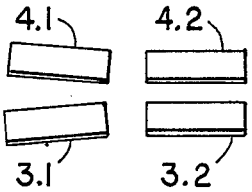

ADJUSTING ROLLER ARRANGEMENT PARTICULARLY FOR ROTARY FOLDERS

BACKGROUND OF THE INVENTION

The present invention relates to an adjusting roller by means of which material webs running in a rotary folding apparatus are influenced. During the production of printed products the material web or webs are often cut into elongated ropes or cords which ar efed to a rotary folder via turning rods, guide rollers,etc. The elongated webs or ropes lying one after another can be thereby slightly deviated or urged so that incorrect or damaging folding would be prevented.

It has been known to utilize width-extending rollers for influencing material webs being treated. One such device has been disclosed in DE-AS No. 26 22 717, in which device for width-stretching of paper webs a roller has been used, which is rotatably supported on a traverse and has supporting elements spaced over the length of the roller, whereby a clamping or tension organ is engaged on the traverse and compensates for a bending tension from the supporting elements in the traverse. Thereby, on the one hand, the so-supported roller is not deflected and, on the other hand, the width-stretching of the paper web must be additionally effected.

Deflecting rollers have been also disclosed in DE-PS No. 27 07 657, in which a tubular roller sleeve is pressed against a counter roller while the roller sleeve is rotatable about a stationary support and is deflected outwardly by hydrostatic pressure elements and is protected against deformations by specific stop devices.

Since high expenses are required for curving the rollers and they should have a stable and thus heavy structure these rollers are suitable for affecting the axially running material webs.

The devices of this type can be, for example used with a mirror-inverted arrangement for a plurality of webs or cut webs not as the adjusting rollers and are in addition very expensive and troublesome.

U.S. Pat. No. 4,412,634 discloses a deflector and inverter device for axially movable strips of flexible sheet material which comprises for each of the strips: an input roller perpendicular to the direction of advance of the strip; an output roller disposed at substantially 90° relative to said input roller; and a deflector bar disposed in an intermediate position with respect to the input and output rollers and operable to support a portion of the strip extending between the rollers means for supporting the bar for rotation. The individual rollers are adjusted to an oblique position. Such a deflector however requires a great deal of space,for example between the funnel-shaped folder and the folding mechanism, which space is not, however available there.

SUMMARY OF THE INVENTION

It is an object of the present invention to provide an adjusting roller by which the aforementioned drawbacks of conventional rollers of the foregoing type would be avoided.

It is another object of the invention to provide an adjusting roller arrangement by means of which the material webs individually or altogether will be influenced in the web guiding devices and fed to further treatment stations.

It is yet another object of the invention to provide an inexpensive adjusting roller which would affect the running material web at many sides thereof.

Still another object of the invention to provide an adjusting roller by means of which the adjustment would be performed over the stationary non-rotating machine frame and rotating structural components which are in connection with the adjusting mechanisms indirectly.

These and other objects of the invention are attained by an adjusting roller arrangement, particularly for a rotation folding apparatus wherein one or a plurality of elongated successfully running webs are fed over a funnel-shaped folder, the arrangement comprisng at least one pair of adjusting rollers mirror-inverted relative to each other and positioned between said funnel-shaped folder and a feeding roller pair of a cylinder folding mechanism, each roller including an axle on which said roller is rotatable, a sleeve at each end thereof, and an adjusting device for horizontally, vertically and axially adjusting said roller, said roller being supported over said sleeves in said adjusting device, each roller including an external roller body divided into at least two portions, a non-rotating internal tube also divided into two portions, said external tube being supported and horizontally adjusted at outer ends thereof over said internal tube relative to said axle. The adjustment takes place at the ends of each roller.

According to a further feature of the invention each roller may have at each end thereof an end shield rigidly connected to said axle and including an overlapping yoke,a tubular end bearing adjustable on said axle, and an adjusting screw, said yoke via said adjusting screw perpendicular to said axle positioning said bearing vertically on said axle, each roller further including two bearing rings, and two roller bearings positioned between said internal tube and said roller body,the portions of which are rotationally supported between said tubular end bearings and the fixed bearing rings on said internal tube.

Said bearing rings may be made of elastic material to receive said internal tube.

Yet in accordance with a further modification each roller may include pivot studs and side guides said receiving studs, said sleeves being pivotable via said pivot studs in said side guides, and at least adjusting spindles, and adjusting bolts said side guides being vertically,-horizontally and axially adjustable by said at least spindles and bolts relative to a multi-part guide cross-piece rigidly connected to a machine frame.

Due to the roller arrangement according to the invention it is possible to adjust the adjusting or correcting rollers exactly at the funnel-shaped folder in accordance with the thickness of the web being treated, and the necessary adjustments for the optimization of the web tension ratio will be easily realized while undesired fold formations will be avoided by these adjustments.

A further advantage of the invention resides in that divided webs are easily separated from each other at predetermined cuts whereby undesired opposite edge effects during a further treatment would be also avoided. Due to the invention all web-affecting possibilities can be offered. Particularly by utilizing the rigid axle the basic adjustment obtained by the adjustment of the rollers relative to the funnel-shaped folder is not changed and then only a necessary adjustment of individual roller bodies of the rollers is necessary. The multiplicity of adjustment possibilities is particularly advantageous.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWINGS

FIG. 6 is a schematic view of the adjusting roller arrangement with one or multiple-web of the elongated folding;

FIG. 6*a* shows a possible adjustment changing of two adjusting rollers in accordance with the path of folding of FIG. 6;

FIGS. 7 and 7*a* show the arrangement similar to that of FIGS. 6 and 6*a* but with the folding web at the funnel-shaped deflector;

FIGS. 8 and 8*a* show the arrangement similar to that of FIGS. 6 and 6*a*, but with a partial web;

FIGS. 9 and 9*a* show a roller arrangement similar to that of FIGS. 6 and 6*a* but without an adjusting device;

FIGS. 10 and 10*a* show the arrangement similar to that of FIGS. 7 and 7*a* but with a two-web drive; and FIGS. 11 and 11*a* show the arrangement similar to that of FIGS. 6 and 6*a* but with a simultaneous feeding of a further partial web.

DETAILED DESCRIPTION OF THE PREFERRED EMBODIMENTS

Figure 1:
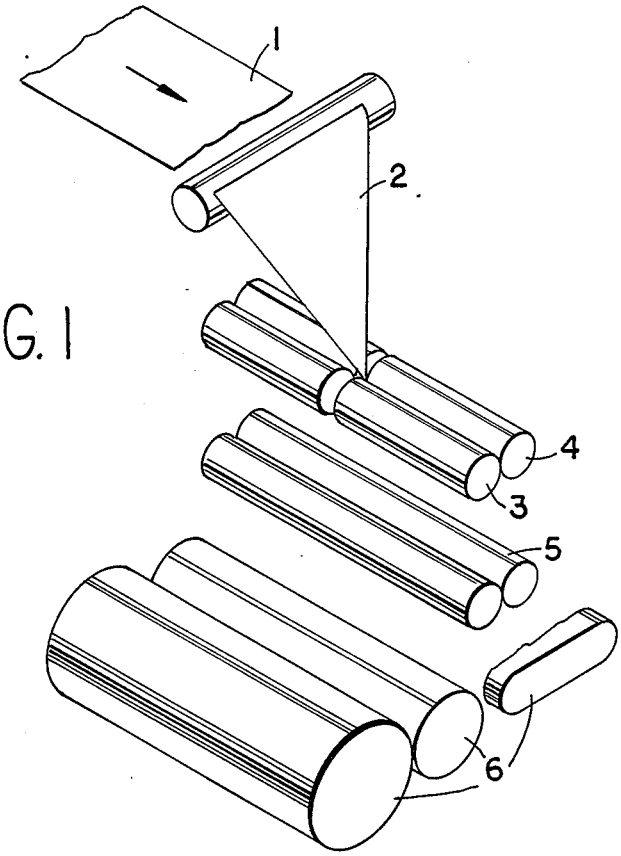
FIG. 1 is a schematic view of an adjusting roller arrangement in a rotary folding device, according to the invention.

Referring now to the drawings in detail it will be seen that a material web or strip is fed from the non-illustrated roller rotary printing machine to a funnel-shaped folder or deflector 2. The material web is then fed over two adjusting rollers 3 and 4 formed according to the invention and extended parallel to each other to a web feeding roller pair 5 of a cylinder folding mechanism 6 as shown in FIG. 1.

Figure 2:
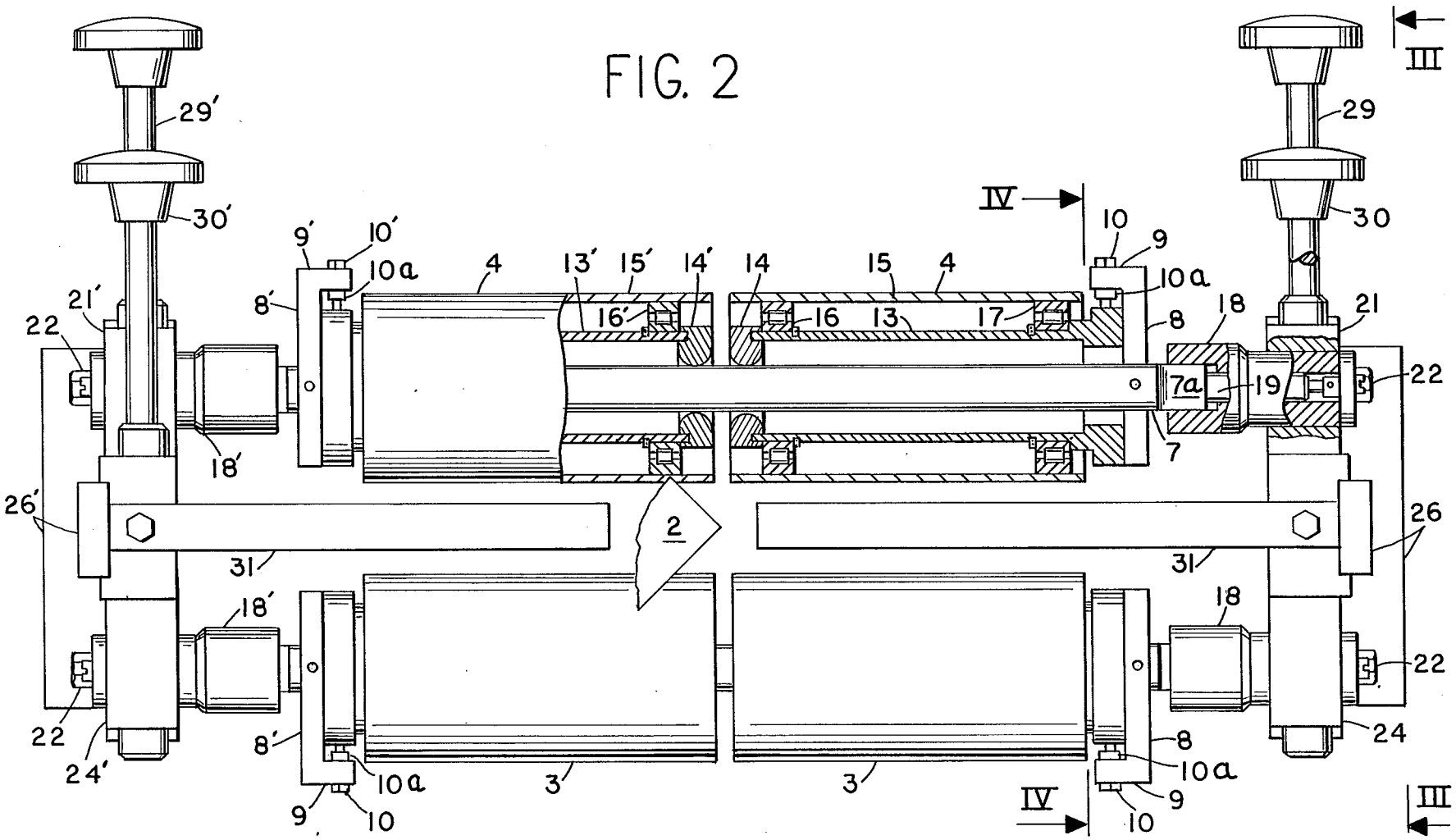
FIG. 2 is a plan view partially in section, of an adjusting roller pair, wherein the adjusting devices and the funnel-shaped deflector are shown schematically.

With reference to FIG. 2 it is seen that the adjusting rollers 3 and 4 are arranged in pairs and mirro-inverted to each other. A tip of the funnel-shaped deflector 2 extends up to the place between the roundings of the adjusting rollers 3 and 4.

Figure 4:
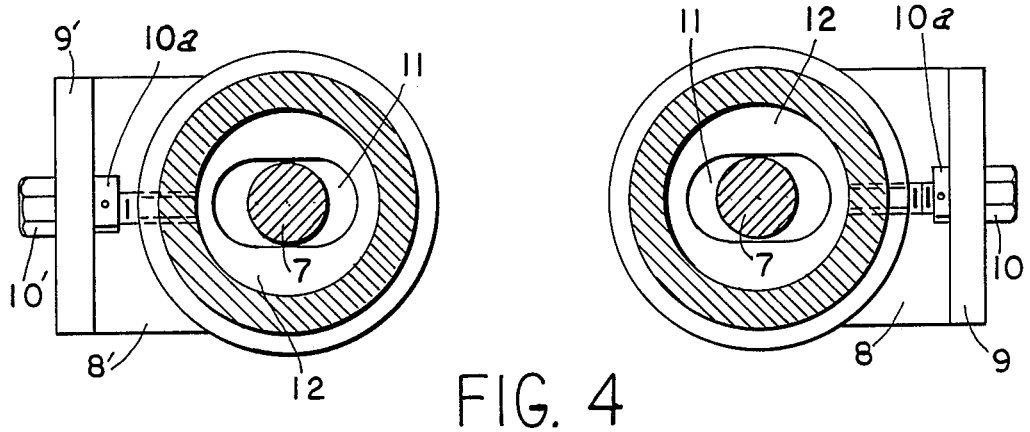
FIG. 4 is a sectional view taken along line IV—IV of FIG. 2.

For the sake of simplicity the structure of only one adjusting roller will be explained herein. At each end of a non-rotating axle 7, an end shield 8, 8′ is rigidly secured, for example by pins. An overlapping yoke 9, 9′ is rigidly connected to the respective shield 8, 8′ and carries, respectively,an adjusting screw 10, 10′. Adjusting screws 10, 10′ which are fixed by detents 10*a* each serve to position a respective tubular sleeve or bearing 12 movable within the limits of an oblong hole 11 as shown in FIG. 4. The tubular bearings 12 merge into internal tubes 13, 13′ which extend up to a separating part of the adjusting rollers 3, 4 and are connected at the place of that separating part rigidly to the axle 7 by means of bearing rings 14, 14′ made preferably of elastic material. Between the internal tubes 13 and 13′ are provided roller bearings 16, 16′ which are positioned in external roller bodies 15, 15. At the ends of each adjusting roller, namely in the regions of tubular bearings or sleeves 12, roller bearings 17 and 17′ are positioned.

The axle 7 has at each end thereof extending outwardly from the yoke 9, 9; a flattened portion 7*a* on which a sleeve 18, 18′ is secured against rotation. Each sleeve 18, 18′ is U-shaped. Each flattened portion 7*a* has a shaft 19 outwardly projecting therefrom.

Figure 3:
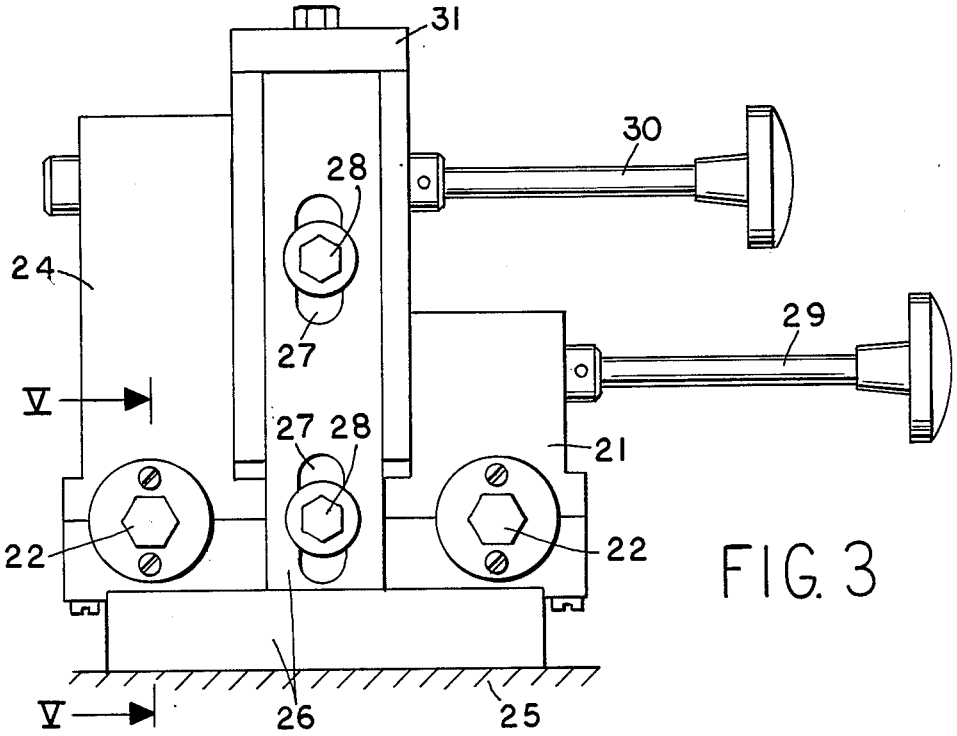
FIG. 3 is a side view of the adjusting device as seen from arrow III of FIG. 2.
Figure 5:
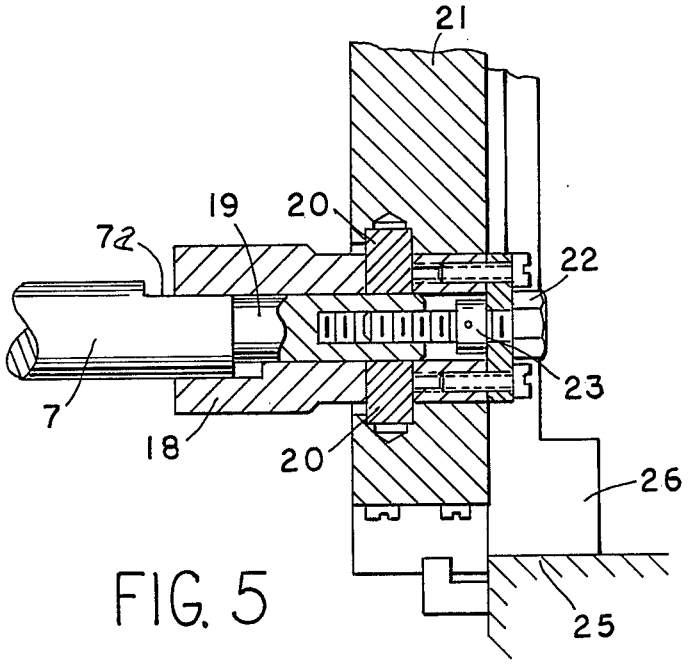
FIG. 5 is a sectional view taken along line V—V of FIG. 3.

As seen from FIG. 5, the sleeve 18 or 18′ is supported horizonally movably within certain limits in lateral guides 21, 21′ by means of two pivot studs. By means of the adjusting screws 22 and by detents 23 connected to the adjusting screws 22, each axle 7 engaged with shafts 19, 19′ is axially adjustable. The vertical adjustment is provided by that the lateral guides 21, 21′ and further lateral guides 24, 24′ of the second axle 7 (FIG. 3) are movable relative to guide cross-piece 26 or 26′, connected to a machine frame 25. For this purpose, two oblong holes 27 receiving respective screws 28 are provided in cross-pieces 26. Axles 7 of the adjusting rollers 3 and 4 are horizontally movable relative to the guide crosspiece 26 or 26′ and securable relative thereto by adjusting spindles 29, 30 and 29′, 30′, respectively, in respective lateral or side guides 21 or 21′, or 24 or 24′. In order to assemble pivot stud pieces 20 the side guides 21, 21′; 24, 24′ are separated vertically relative to the central axis. the funnel-shaped folder or deflector does not overlap the play between the adjusting rollers 3 and 4, and this play is covered by hand supports 31 secured to the machine frame 25.

After the assembling of the above described device a number of possibilities can be executed, in order to vertically move, firstly the side guides 21 and 24 or 21′ and 24′ and thus adjust the rollers 3 and 4 relative to the tip of the funnel-shaped deflector 2, screws 28 are loosened. If required there is a possibility to adjust adjusting rollers 3 and 4, without further expense, by means of adjusting spindles 29, and 29′; 30 and 30′ in the horizontal direction. For the axial adjustment of the rollers 3 and 4 only the adjusted screws 29 at the ends of axles 7 should be adjusted. According to each individual operation all the requirements can be satisfied and the roller bodies 15 or 15′ of both rollers 3 and 4 on the stationary bolts 10, 10′ are effected so as to obtain a desired effect by an oblique position of the roller body to the axle 7.

The multiplicity of adjustment possibilities is shown by arrows in FIG. 6. Various possibilities of the adjustments of rollers 3, 4 will be explained in connection with FIGS. 6 to 11.

In order to prevent, with the one or multi-web folding operation, the occurrence of undesired fold formations and to make the web tension at the tip of the funnel-shaped folder optional the adjusting rollers 3, 4 are advantageously adjusted at one side of the folder 2 as shown in FIG. 6*a*. For this purpose the tubular bearings 12′ on both adjusting rollers 3 and 4 are adjusted to each other by the rotation of the adjusting bolts 10′.

On the ground of different web tensions distributed over the width of the web,the course of the web passing through the folder can be adjusted as shown in FIGS. 7 and 7*a*. To obtain this adjustment, the adjusting bolts 10 and 10′ are rotated. With this adjustment, for example a non-uniform web tension at the sides can be compensated.

It is advisable under the circumstances to move the web portions passing the folder away from each other by a small amount. As seen from FIGS. 8 and 8*a* the adjusting bolts 10 and 10' are respectively rotated. Upon a further running of the webs a non-desired opposite edge influence will be avoided with this adjustment.

As shown in FIGS. 9 and 9*a* a full parallel adjustment of the rollers 3 and 4 is necessary. The adjustment is executed by adjusting bolts 10 and 10' or by adjusting spindles 29, 29', 30, 30'.

It is also necessary eventually to compensate for web tensions by a more or less strong adjustment of all roller bodies 15 and 15' as shown in FIGS. 10 and 10*a*. By the rotation of the adjusting bolts 10 and 10' the webs passing the folder are individually affected.

Whenever other versions are conceivable, as seen from FIGS. 11 and 11*a*, the processing and influencing of non-uniform webs or web portions which are fed through the folder and at the folder can be executed by the arrangement according to the invention so that all the necessary corrections would be made by adjustments of the rollers for each operation.

It will be understood that each of the elements described above, or two or more together, may also find a useful application in other types of adjusting rollers particularly for rotary folders differing from the types decribed above.

While the invention has been illustrated and described as embodied in an adjusting roller particularly for rotary folders, it is not intended to be limited to the details shown, since various modifications and structural changes may be made without departing in any way from the spirit of the present invention.

Without further analysis, the foregoing will so fully reveal the gist of the present invention that others can, by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims.

I claim:

1. An adjusting roller arrangement, particularly for a rotation folding apparatus wherein one or a plurality of elongated successively running webs are fed over a funnel-shaped folder, the arrangement comprising at least one pair of adjusting rollers (3,4) mirror-inverted relative to each other and positioned between said funnel-shaped folder and a feeding roller pair (5) of a cylinder folding mechanism (6), each roller including an axle on which said roller is rotatable, a sleeve (18, 18') at each end thereof, and an adjusting device (21, 29; 24, 30; 27,28; 22,23) for horizontally, vertically and axially adjusting said roller, said roller being supported over said sleeves in said adjusting device, each roller including an external roller body (15, 15') divided into at least two portions, a non-rotating internal tube also divided into two portions, said external tube being supported and horizontally adjusted at outer ends thereof over said internal tube (13, 13') relative to said axle.

2. The arrangement as defined in claim 1, wherein each roller has at each end thereof an end shield (8,8') rigidly connected to said axle, and including an overlapping yoke (9,9'), a tubular end bearing (12) adjustable on said axle, and an adjusting screw (10, 10'), said yoke via said adjusting screw perpendicular to said axle positioning said bearing vertically on said axle, each roller further including two bearing rings (14, 14') and two roller bearings (16, 16'; 17, 17') positioned between said internal tube and said roller body,the portions of which are rotationally supported between said tubular end bearings (12) and said bearing rings on said internal tube.

3. The arrangement as defined in claim 2, wherein said bearing rings are made of elastic material to receive said internal tube.

4. The arrangement as defined in claim 2, wherein each roller includes pivot studs (20) and side guides (21, 21'; 24,24') receiving said pivot studs, said sleeves being pivotable via said pivot studs in said side guides, and at least adjusting spindles (29, 29' and 30, 30') and adjusting bolts (22, 27), said side guides being vertically, horizontally and axially adjustable by said at least spindles and bolts relative to a multi-part guide cross-piece (26, 26') rigidly connected to a machine frame.

* * * * *